US008913917B2

(12) United States Patent
Liu et al.

(10) Patent No.: US 8,913,917 B2
(45) Date of Patent: Dec. 16, 2014

(54) SYSTEMS AND METHODS FOR CLEANING BIAS CHARGE ROLL SURFACE IN PRINTING SYSTEMS

(71) Applicant: Xerox Corporation, Norwalk, CT (US)

(72) Inventors: Yu Liu, Mississauga (CA); Johann Junginger, Toronto (CA); Sarah Vella, Milton (CA); Nan-xing Hu, Oakville (CA); Vlad Skorokhod, Vaughan (CA); Greg McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/747,459

(22) Filed: Jan. 22, 2013

(65) Prior Publication Data

US 2014/0205312 A1 Jul. 24, 2014

(51) Int. Cl.
*G03G 15/02* (2006.01)

(52) U.S. Cl.
USPC ..... 399/100

(58) Field of Classification Search
CPC ..... G03G 15/0225; G03G 15/168; G03G 2215/1647; G03G 2215/1652; G03G 2215/1657; G03G 2215/1661; G03G 2215/021; G03G 2215/023; G03G 2221/0021
USPC ..... 399/100, 101, 174, 175, 176
See application file for complete search history.

(56) References Cited

U.S. PATENT DOCUMENTS

| | | | | |
|---|---|---|---|---|
| 4,111,545 | A * | 9/1978 | Meltzer | 399/351 |
| 6,539,186 | B2 * | 3/2003 | Kitazawa et al. | 399/100 |
| 7,616,913 | B2 | 11/2009 | Matsui et al. | |
| 7,734,212 | B2 * | 6/2010 | Miyaji et al. | 399/100 |
| 7,813,667 | B2 | 10/2010 | Zona | |
| 7,894,741 | B2 * | 2/2011 | Shinkawa et al. | 399/100 |
| 2013/0343782 | A1 * | 12/2013 | Liu et al. | 399/176 |

FOREIGN PATENT DOCUMENTS

| | | | |
|---|---|---|---|
| JP | 11143183 | A * | 5/1999 |
| JP | 2001117330 | A * | 4/2001 |
| JP | 2009037053 | A * | 2/2009 |
| JP | 2010078778 | A * | 4/2010 |

* cited by examiner

*Primary Examiner* — Robert Beatty
(74) *Attorney, Agent, or Firm* — Ronald E. Prass, Jr.; Prass LLP

(57) ABSTRACT

A vibration-assisted bias charge roll cleaning system includes a bias charge roll cleaning member connected to an actuator for causing the cleaning member to vibrate. The actuator is controlled to vibrate according to a predetermined pattern, and at desired frequencies at particular modes. The cleaning member is configured to be movable to a contact-cleaning position and a cleaning member cleaning position at which the cleaning member is separate from the charge roll.

18 Claims, 3 Drawing Sheets

SYSTEMS AND METHODS FOR CLEANING BIAS CHARGE ROLL SURFACE IN PRINTING SYSTEMS

FIELD OF DISCLOSURE

The disclosure relates to methods and systems for a cleaning a bias charge roll used to charge a photoreceptor useful in printing systems. In particular, the disclosure relates to cleaning a charging roll surface to extending bias charge roll and photoreceptor useful life for printing.

BACKGROUND

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. An electrostatic latent image is formed on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a bias charge member roller (BCR) is increasingly used as the major charging apparatus in xerographic systems due to environment friendliness and excellent charging performance. A BCR provides several advantages over traditional scorotron charging: a) uniform and stable charging; b) reduced emissions of ozone or other corona by-products; c) lower AC/DC voltage supply requirements; and d) reduced service maintenance.

The BCR suffers, however, from toner/additive contamination over many printing cycles reducing overall service life of BCR. Significant amounts of effort have been put to suppress the contamination on BCR. For example, U.S. Pat. Nos. 8,126,344; 7,711,285; 7,526,243; 7,266,338; 7,079,786; 6,836,638; 6,470,161 are using dedicated cleaning systems to alleviate the adherence of particles trapped on the cleaning surface of a photoreceptor. On the other hand, U.S. Pat. No. 8,116,655, US20090169237, U.S. Pat. No. 6,381,432, US20040019986, U.S. Pat. Nos. 7,899,354, 8,064,791, US20110170896, US20110170897 propose direct cleaning systems to clean BCR surface for extended lifetime.

SUMMARY

Constant contact between the cleaning system and the BCR surface over long time periods may cause bleeding and degradation of the BCR surface. Therefore, there is a continuing need for a more effectively configured BCR cleaning system. Related art systems for bias charge roll cleaning exhibit inferior performance in xerographic printing systems, particularly those imaging apparatus using over-coated photoreceptor members. For example, wear of the cleaning blade caused by a hard over-coated photoreceptor contributes to wear of the bias charge roll and accelerates degradation of a bias charging member configured to contact and charge the photoreceptor. Cleaning systems and methods useful for xerographic printing systems including those incorporating over-coated photoreceptors are desired. A vibration-assisted cleaning unit is provided that extends bias charge roll and the imaging apparatus life.

An embodiment of systems may include a xerographic printing system having a bias charge roll; a bias charge roll vibration-assisted cleaning system configured to vibrate a cleaning member, the cleaning system having an actuating unit; and an elastomeric cleaning member, the actuating unit configured for causing the elastomeric cleaning member to vibrate and contact the bias charge roll intermittently. In systems, the actuating unit may be selected from a group consisting essentially of a piezoelectric transducer, an electrical motor, a pneumatic actuator, a hydraulic actuator, a linear actuator, a combo drive, thermal bimorphs, and electroactive polymers.

In systems the actuating unit may be configured to vibrate at a frequency in a range of about 0.1 Hz to about 10 kHz. The actuating unit may be configured to vibrate with a duty cycle in a range of about 5% to about 95%. The actuating unit may be configured to vibrate at an amplitude in a range of about 5 μm to about 1000 μm.

In systems, the elastomeric cleaning member may be selected from a group consisting essentially of a roller, a brush, a pad, and a blade. In systems, the cleaning system may be configured to cause the elastomeric cleaning member to move away from the charge roll during an idle time position for reducing pro-longed contact between the charge roll and the cleaning member. In systems, the actuating unit may be powered by a driving waveform selected from a group consisting of square, sinusoid, and sawtooth. In a preferred embodiment, the actuating unit is a piezoelectric transducer. In systems, the actuating unit being configured whereby a vibrational frequency of the cleaning member is modulated at a time when the cleaning member contacts the charge roll for minimizing friction between the charge roll and the cleaning member.

An embodiment of methods of may include a bias charge roll cleaning method useful for xerographic printing, including causing a charge roll cleaning member to contact a bias charge roll for cleaning a surface of the charge roll in a charge roll cleaning position; and causing the cleaning member to separate from the charge roll to a cleaning member cleaning position. Methods may include causing the cleaning member to vibrate the cleaning member according to a vibration pattern configured for cleaning the cleaning member. Methods may include causing the cleaning member to vibrate in a charge member contact position. Methods may include the causing the member to contact the charge roll further including causing the cleaning member to intermittently contact the charge roll. In embodiments, methods may include causing the cleaning member to vibrate in the charge member cleaning position at a first frequency; and causing the cleaning member to vibrate in the cleaning member cleaning position at a second frequency, the second frequency being different than the first frequency.

An embodiment of apparatus may include an image forming apparatus useful for xerographic printing, which may include a bias charge roll; a photosensitive member for receiving an electrostatic latent image; a development system for applying developer material to said photosensitive member surface; a transfer system for transferring the developed image from said photosensitive member surface to a substrate; a cleaning blade for contacting said photosensitive member surface; and a vibration-assisted cleaning system comprising: an actuating unit to provide said vibration; an elastomeric cleaning member in intermittent contact with said bias charging roll surface to provide cleaning.

Apparatus may include the actuating unit being selected from a group consisting essentially of a piezoelectric transducer, electrical motor, pneumatic actuator, hydraulic actuator, linear actuator, combo drive, thermal bimorphs, and electroactive polymers. Apparatus may include the image forming apparatus wherein the elastomeric cleaning member is selected from a group consisting essentially of a roller, a brush, a pad and a blade. In an embodiment, apparatus may be configured for lifting the elastomeric cleaning member away from said bias charge roll during idle time to prevent long-term contact between said bias charge roll and the elastomeric cleaning member. In an embodiment, apparatus may be configured for modulating the frequency when said elastomeric cleaning member is in the period of contact with the surface portion of the bias charge roll to minimize friction between the bias charge roll and the surface portion of the elastomeric cleaning member.

Exemplary embodiments are described herein. It is envisioned, however, that any system that incorporates features of apparatus and systems described herein are encompassed by the scope and spirit of the exemplary embodiments.

DETAILED DESCRIPTION

Exemplary embodiments are intended to cover all alternatives, modifications, and equivalents as may be included within the spirit and scope of the systems and methods as described herein.

Figure 1:
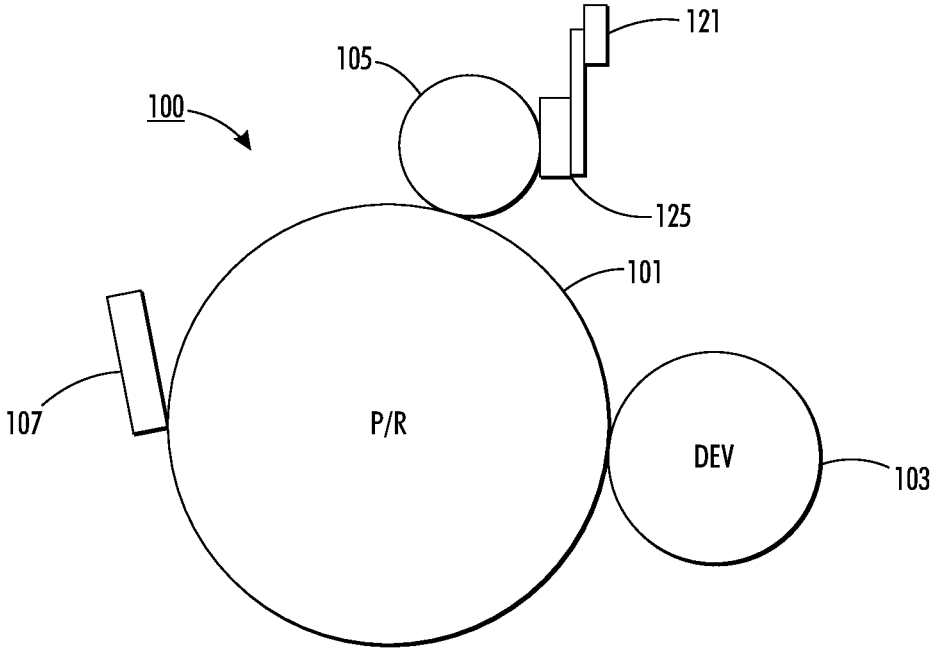
FIG. 1 shows a diagrammatical view of a xerographic printing system including a bias charge roll cleaning system in accordance with an embodiment.

Cleaning systems and methods useful for xerographic printing systems, including those incorporating over-coated photoreceptors are provided. In particular, a vibration-assisted cleaning unit is provided that extends bias charge roll and photoreceptor life. FIG. 1 shows a diagrammatic view of a xerographic printing system including a charge roll cleaning system in accordance with an embodiment.

Figure 2A:
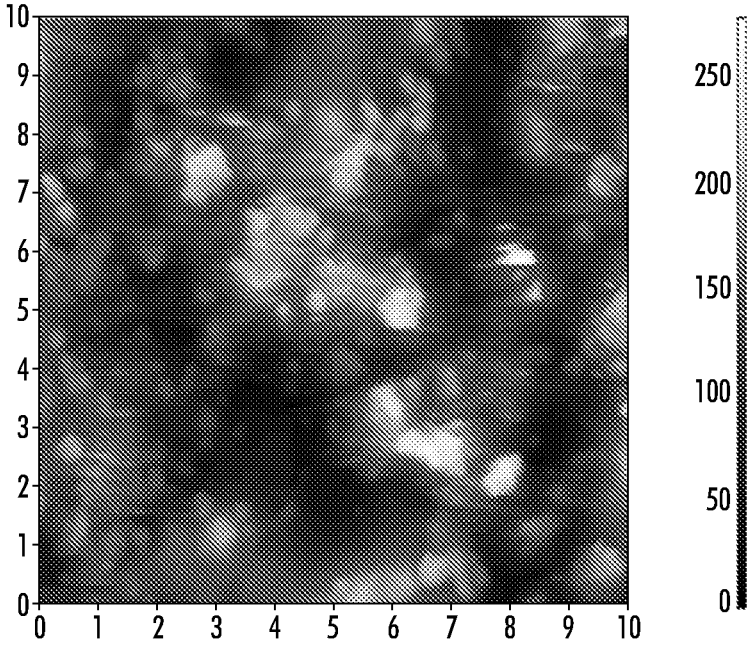
FIG. 2A shows a microscopic view of a surface of a new bias charge roll.
Figure 2B:
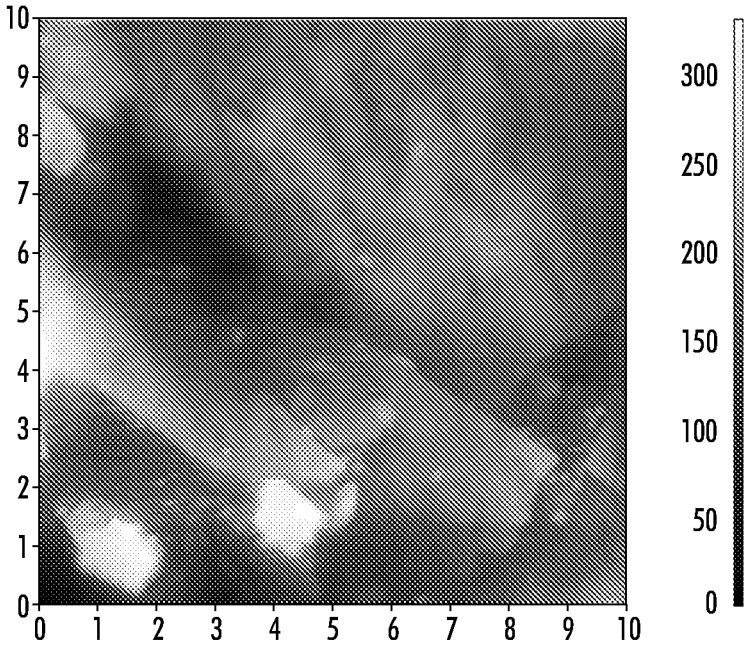
FIG. 2B shows a microscopic view of a surface of a used bias charge roll.

It has been found that bias charge roll cleaning units such as those that rely on constant contact between a cleaning member and the charge roll cause roll degradation. For example, a cleaning member such as a foam roll causes smoothing of the charge roll surface after only 10 thousand prints using related art systems. FIG. 2A shows an image of the charge roll surface of a fresh BCR before use in a xerographic printing system. FIG. 2B shows an image of the charge roll surface after use; wear has caused bleeding and degradation of the surface. Charge roll cleaning systems and methods in accordance with embodiments minimize damage of the bias charge roll surface and the cleaning unit to enable long life of xerographic printing components.

Systems include a vibration-assisted cleaning unit or cleaning system that is operably connected to a power source and controller. The system includes a cleaning member that is configured to vibrate according to controllable vibration patterns. A cleaning system includes the cleaning member, which may be a brush or foam strip or roll. The system includes a vibrating unit such as a PZT-driven vibrating unit connected to the cleaning member. Alternative actuators may include a piezoelectric transducer, an electrical motor, a pneumatic actuator, a hydraulic actuator, a linear actuator, a combo drive, thermal bimorphs, and electroactive polymers or other suitable actuating unit. The actuating unit is connected to a vibrating frequency generator controllable by a now known or later developed controller.

Methods may include causing a cleaning member to contact a bias charge roll surface. Methods may include separating the cleaning member contacting the bias charge roll surface from the bias charge roll surface, and vibrating the cleaning member to remove accumulated particles from the cleaning member. Methods may include vibrating the cleaning member while the cleaning member is contacting the bias charge roll. Methods may include moving the cleaning member to intermittently contact the charging member in a charging member cleaning position.

FIG. 1 shows a xerographic printing system 100 including a photoreceptor 101. The photoreceptor 101 may be a rotatable cylinder as shown, and may be configured for imaging using a developer roll 103 that contacts the photoreceptor 101 to provide toner, and a bias charge roll 105 that contacts and charges the photoreceptor 101 for xerographic printing. A cleaning blade 107 is configured to clean the photoreceptor 101 to remove remaining toner, additive, etc. from the photoreceptor surface. Remaining toner and additive may cause wear of, and may be accumulated by the charge bias roll 105 that contacts the photoreceptor 101 for printing. The photoreceptor surface may include an overcoat material suitable for printing.

In accordance with embodiments, FIG. 1 shows a vibration-assisted cleaning system 121. The cleaning system 121 includes a cleaning member 125. The cleaning member 125 may be a strip, bar, brush, or roll. The member may be made from any suitable material such as foam, or other now known or later developed material. Preferably, the cleaning member comprises an elastomeric surface. The cleaning member 125 is connected to a vibrating actuator (not shown) such as a PZT. The vibrating actuator, or actuating unit, is connected to a controller and may be configured for controlled vibration according to desired vibration patterns. In alternative embodiments, the vibrating unit may be a piezoelectric transducer, an electrical motor, a pneumatic actuator, a hydraulic actuator, a linear actuator, a combo drive, thermal bimorphs, and/or electroactive polymers. In systems, the vibration-assisted cleaning system may be configured to have a driving waveform of square, sinusoid, and sawtooth, as understood by one of ordinary skill in the art. The cleaning system 121 may be configured to move for contacting the photoreceptor surface and separating from the photoreceptor surface, and may be connected to and controlled by a controller. The actuating unit may be configured and/or controlled to vibrate the cleaning member at a frequency from about 0.1 Hz to about 10 kHz, or from about 1 Hz to about 1 kHz, or from about 50 Hz to about 500 Hz. The actuating unit may be configured to vibrate the cleaning member with a duty cycle that lies in a range of about 5% to about 95%. The actuating unit may be configured to vibrate the cleaning member at an amplitude that lies in a range of about 5 μm to about 1000 μm or about 20 μm to about 500 μm or about 50 μm to about 200 μm.

Figure 3:
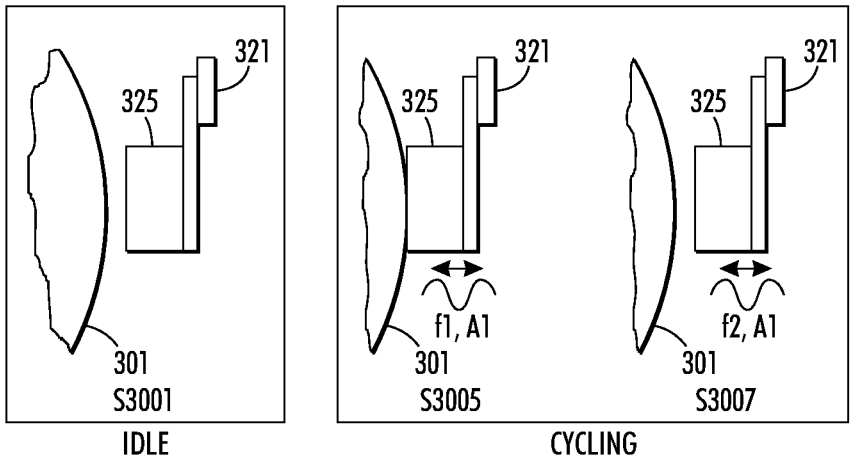
FIG. 3 shows a diagrammatical view of a xerographic printing system including a bias charge roll cleaning system in accordance with an embodiment and corresponding cleaning methods in accordance with an embodiment.

FIG. 3 shows systems and methods in accordance with an embodiment. FIG. 3 shows a photoreceptor 301 and a cleaning system 321 with cleaning member 325. The cleaning member 325 is a bar, which may be foam, or may include a brush. The cleaning member may be roller, pad, or blade. Preferably, the cleaning member includes an elastomeric surface. Methods may include lifting or separating the cleaning member 321 from the photoreceptor surface, and/or beginning a printing process or cycle in a separated state, at S3001.

Methods may include causing the cleaning system 321 to cause the cleaning member 325 to contact the photoreceptor surface at S3005. In an embodiment, the cleaning member may not be vibrating at S3005. In another embodiment, the cleaning member may be caused at S3005 to vibrate in a first mode, or charge member cleaning mode. The cleaning system 321 may be controlled to vibrate according to a predetermined photoreceptor charge member cleaning mode pattern, for example a first frequency f1 and first amplitude A1 that causes intermittent contact between the cleaning member 325 and the photoreceptor charge member surface during cleaning. The cleaning system 321 may be configured to cause the cleaning member 325 to separate from the photoreceptor surface at S3007. At the S3007, the cleaning system 321 causes the cleaning member 325 to vibrate in a second mode, a cleaning member cleaning mode, for example, a second frequency f1 and first amplitude A1. The cleaning member 325 may be caused to vibrate at a second frequency, such as a high frequency for removing accumulated additive and toner in the offset position, away from a surface of the photoreceptor.

Figure 4:
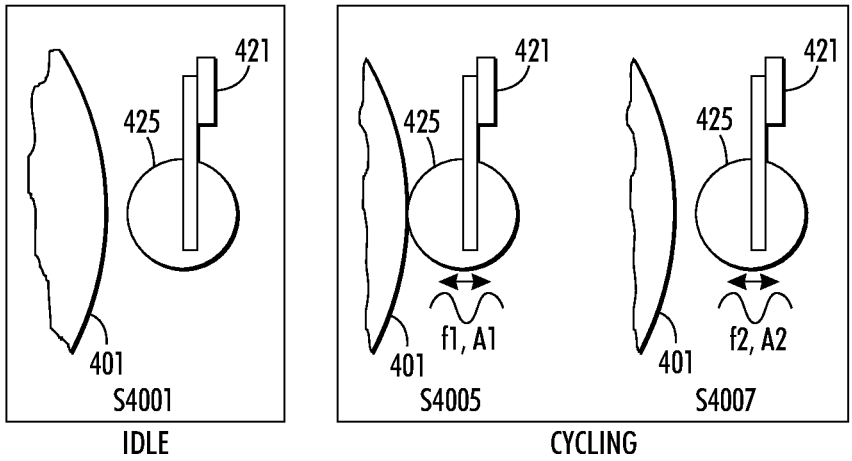
FIG. 4 shows a diagrammatical view of a xerographic printing system including a bias charge roll cleaning system in accordance with an embodiment and corresponding cleaning methods in accordance with an embodiment.

FIG. 4 shows systems and methods in accordance with an embodiment. FIG. 4 shows a photoreceptor 401 and a cleaning system 421 with cleaning member 425. The cleaning member 425 is a roll, which may be foam, or may include a brush. Methods may include lifting or separating the cleaning member 421 from the photoreceptor surface, and/or beginning a printing process in a separated stated at S4001.

Methods may include causing the cleaning system 421 to cause the cleaning member 425 to contact the photoreceptor surface at S4005. In an embodiment, the cleaning member may not be vibrating at S4005. In another embodiment, the cleaning member may be caused at S4005 to vibrate in a first mode, a charge member cleaning mode. The cleaning system 421 may be controlled to vibrate according to a photoreceptor charge member cleaning mode pattern, for example a first frequency f1 and first amplitude A1 that causes intermittent contact between the cleaning member 425 and the photoreceptor charge member surface during cleaning.

The cleaning system 421 may be configured to cause the cleaning member 425 to separate from the photoreceptor surface at S4007. At the S4007, the cleaning system 421 causes the cleaning member 425 to vibrate in a second mode, a cleaning member cleaning mode, for example, a second frequency f1 and first amplitude A1. The cleaning member 425 may be caused to vibrate at a high frequency for removing accumulated additive and toner in this offset position, away from a surface of the photoreceptor.

EXAMPLE

A system in accordance with embodiments included a vibration-assisted cleaning system as disclosed, which was test on a paperless fixture. A customer replaceable unit was used for testing, and included a cleaning system having a PZT actuator, a brush assembly, and a PZT control unit for different frequencies from 0.1 Hz up to 3000 kHz. For comparison, the brush length is only about ⅓ of the full length of the BCR. The photoreceptor was run at a speed of 1 rps. The cleaning system was set at 200 Hz, amplitude at about 100 micrometers in both charge member cleaning and cleaning member cleaning or offset modes (f1=f2; A1=A2 in FIG. 3). A solid toner patch was uniformly applied to the photoreceptor surface and cleaned by a cleaning blade. A total of 5000 cycles were carried out; reduced wear and improved cleaning were observed at the ⅓ length side of the BCR as cleaned by the cleaning system.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A xerographic printing system, comprising:

a bias charge roll;

a bias charge roll vibration-assisted cleaning system configured to vibrate a cleaning member in a charge roll cleaning position and a cleaning member cleaning position, the cleaning system comprising:

an actuating unit; and an elastomeric cleaning member, the actuating unit configured for causing the elastomeric cleaning member to vibrate and contact the bias charge in the charge roll cleaning position at a first frequency; and causing the cleaning member to vibrate in the cleaning member cleaning position at a second frequency, the second frequency being different than the first frequency.

2. The system of claim 1, wherein the actuating unit is selected from a group consisting essentially of a piezoelectric transducer, an electrical motor, a pneumatic actuator, a hydraulic actuator, a linear actuator, a combo drive, thermal bimorphs, and electroactive polymers.

3. The system of claim 1, the actuating unit being configured to vibrate at a frequency in a range of about 0.1 Hz to about 10 kHz.

4. The system of claim 1, the actuating unit being configured to vibrate with a duty cycle in a range of about 5% to about 95%.

5. The system of claim 1, the actuating unit being configured to vibrate at an amplitude in a range of about 5 μm to about 1000 μm.

6. The system of claim 1, the elastomeric cleaning member being selected from a group consisting essentially of a roller, a brush, a pad, and a blade.

7. The system of claim 1, the cleaning system being configured to cause the elastomeric cleaning member to move away from the charge roll during an idle time position for reducing pro-longed contact between the charge roll and the cleaning member.

8. The system of claim 1, the actuating unit being powered by a driving waveform selected from a group consisting of square, sinusoid, and sawtooth.

9. The system of claim 1, the actuating unit being configured whereby a vibrational frequency of the cleaning member is modulated at a time when the cleaning member contacts the charge roll for minimizing friction between the charge roll and the cleaning member.

10. A bias charge roll cleaning method useful for xerographic printing, comprising:

causing a charge roll cleaning member to contact a bias charge roll for cleaning a surface of the charge roll in a charge roll cleaning position;

causing the cleaning member to vibrate in the charge member cleaning position at a first frequency intermittently and during printing; and causing the cleaning member to vibrate in the cleaning member cleaning position at a second frequency, the second frequency being different than the first frequency.

11. The method of claim 10, comprising:

causing the cleaning member to vibrate the cleaning member according to a vibration pattern configured for cleaning the cleaning member.

12. The method of claim 10, comprising:

causing the cleaning member to vibrate in a charge member contact position.

13. The method of claim 10, the causing the member to contact the charge roll further comprising:

causing the cleaning member to intermittently contact the charge roll.

14. An image forming apparatus useful for xerographic printing, comprising:

a bias charge roll;

a photosensitive member for receiving an electrostatic latent image;

a development system for applying developer material to said photosensitive member surface;

a transfer system for transferring the developed image from said photosensitive member surface to a substrate;

a cleaning blade for contacting said photosensitive member surface; and a vibration-assisted cleaning system comprising:

an actuating unit to provide said vibration by causing the cleaning member to vibrate in a charge member cleaning position at a first frequency intermittently and during printing; and causing the cleaning member to vibrate in a cleaning member cleaning position at a second frequency, the second frequency being different than the first frequency; and an elastomeric cleaning member in intermittent contact with said bias charging roll surface to provide cleaning.

15. The image forming apparatus of claim 14, wherein the actuating unit is selected from a group consisting essentially of a piezoelectric transducer, electrical motor, pneumatic actuator, hydraulic actuator, linear actuator, combo drive, thermal bimorphs, and electroactive polymers.

16. The image forming apparatus of claim 14, wherein the elastomeric cleaning member is selected from a group consisting essentially of a roller, a brush, a pad and a blade.

17. The image forming apparatus of claim 14, the apparatus being configured for lifting said elastomeric cleaning member away from said bias charge roll during idle time to prevent long-term contact between said bias charge roll and said elastomeric cleaning member.

18. The image forming apparatus of claim 14, the apparatus being configured for modulating said frequency when said elastomeric cleaning member is in the period of contact with said surface portion of said bias charge roll to minimize friction between said bias charge roll and said surface portion of said elastomeric cleaning member.

* * * * *